US009121179B2

(12) United States Patent
Bublitz

(10) Patent No.: US 9,121,179 B2
(45) Date of Patent: Sep. 1, 2015

(54) ROOF AND RAIN GUTTER ICE MELT SYSTEM AND ASSEMBLY

(76) Inventor: Gregory S. Bublitz, Delafield, WI (US)

( * ) Notice: Subject to any disclaimer, the term of this patent is extended or adjusted under 35 U.S.C. 154(b) by 458 days.

(21) Appl. No.: 13/291,304

(22) Filed: Nov. 8, 2011

(65) Prior Publication Data

US 2012/0168419 A1 Jul. 5, 2012

Related U.S. Application Data

(60) Provisional application No. 61/429,927, filed on Jan. 5, 2011.

(51) Int. Cl.
*E04D 13/076* (2006.01)
*E04D 13/10* (2006.01)

(52) U.S. Cl.
CPC ..... *E04D 13/0762* (2013.01); *E04D 13/103* (2013.01)

(58) Field of Classification Search
CPC ..... E04D 13/00; E04D 1/36
USPC ..... 219/213; 52/11, 12; 248/48.1, 237
See application file for complete search history.

(56) References Cited

U.S. PATENT DOCUMENTS

| | | | | |
|---|---|---|---|---|
| 4,043,527 | A | 8/1977 | Franzmeier | |
| 4,081,657 | A | 3/1978 | Stanford | |
| 4,134,002 | A * | 1/1979 | Stanford | 219/213 |
| 4,308,696 | A | 1/1982 | Schroeder | |
| 4,769,526 | A * | 9/1988 | Taouil | 219/213 |
| 5,391,858 | A * | 2/1995 | Tourangeau et al. | 219/213 |
| 5,457,916 | A * | 10/1995 | Tenute | 52/12 |
| 5,836,344 | A * | 11/1998 | Hovi, Sr. | 137/357 |
| 5,878,533 | A * | 3/1999 | Swanfeld, Jr. | 52/11 |
| 6,708,452 | B1 * | 3/2004 | Tenute | 52/11 |
| 6,759,630 | B1 * | 7/2004 | Tenute | 219/213 |
| 6,959,512 | B2 | 11/2005 | Cobb | |
| 6,978,577 | B2 | 12/2005 | Jones | |
| 7,287,354 | B2 * | 10/2007 | Rivers et al. | 52/220.1 |
| 8,079,183 | B2 * | 12/2011 | Lenney | 52/12 |
| 2005/0183343 | A1 * | 8/2005 | Jones | 52/11 |
| 2006/0037252 | A1 * | 2/2006 | Gosse et al. | 52/11 |
| 2006/0117670 | A1 | 6/2006 | Tsioris | |
| 2006/0196124 | A1 * | 9/2006 | Bachman | 52/12 |
| 2006/0277831 | A1 * | 12/2006 | Bachman | 52/11 |
| 2006/0283096 | A1 | 12/2006 | Bachman | |
| 2006/0288652 | A1 | 12/2006 | Gurr | |
| 2007/0246449 | A1 | 10/2007 | Bachman | |
| 2010/0287846 | A1 * | 11/2010 | Lenney | 52/12 |
| 2011/0049118 | A1 * | 3/2011 | Nark | 219/213 |
| 2011/0297662 | A1 * | 12/2011 | Clark et al. | 219/213 |

* cited by examiner

*Primary Examiner* — Dana Ross
*Assistant Examiner* — Frederick Calvetti
(74) *Attorney, Agent, or Firm* — Joseph S. Heino; Patrick M. Bergin

(57) ABSTRACT

A roof and rain gutter ice melt system and assembly provide a base panel and a cover panel. The base panel is functionally adapted to be mounted at a roof edge at the back wall of a conventional rain gutter. In one embodiment, the base panel also includes means for supporting a heat cable within it. Electrical energization of the heat cable results in the conduction of heat through the base panel and through the cover panel, the cover panel including means of overlapping and engaging the base panel. A second heat cable is disposed in the floor of the rain gutter. In an alternative embodiment, the heat cable is disposed within a roof edge panel. In either alternative embodiment, a front panel can be provided to allow the front lip of the rain gutter to be heated atop a metal gutter screen.

8 Claims, 2 Drawing Sheets

ROOF AND RAIN GUTTER ICE MELT SYSTEM AND ASSEMBLY

This application claims the benefit and priority of U.S. Provisional Patent Application No. 61/429,927 filed Jan. 5, 2011.

FIELD OF THE INVENTION

This invention relates generally to devices, systems, assemblies and methods that are used to prevent snow and ice build-up from occurring in and around rain gutters that are mounted to the roof edges of a building. More specifically, it relates to a snow and ice melting system and assembly that can be installed at a conventional roof edge rain gutter to prevent the build-up of snow and ice near the gutter, the device using electric energy that is converted to heat to melt the snow and ice as it falls onto or advances toward the roof edge and rain gutter.

BACKGROUND OF THE INVENTION

A number of static and dynamic factors can combine to create ice dams at the edge of a roof. Such factors include the way that the roof is constructed and insulated, both of which impact the amount of heat loss that is created at the roof edge via heat conduction and convection. Other factors typically include snowfall amounts, snow cover amounts, outside temperatures and radiation, or the exposure of the roof and roof edge to direct sunlight, or the absence of such exposure.

Where the factors mentioned above cannot be controlled, a roof and rain gutter ice melt system and assembly can be used to eliminate such ice dams, or to prevent creation of an ice dam in the first instance. In the experience of this inventor, a number of configurations have been used to accomplish the intended purpose of eliminating or preventing ice dams. Some configurations, though effective, are often complex in construction which makes them potentially expensive to fabricate and also expensive to install. Some configurations are also relatively expensive to operate due to inherent inefficiencies in the system or assembly.

In the view of this inventor, there is a need for a simplified system and assembly that provides the functionality of eliminating or preventing ice dams and that is also relatively simple in construction and installation. In the experience of this inventor, such a system and assembly exists and is the subject of the present invention.

SUMMARY OF THE INVENTION

The roof and rain gutter ice melt system and assembly of the present invention provides a base panel and a cover panel. The base panel is functionally adapted to be mounted at a roof edge at the back wall of a conventional rain gutter, although the base panel could be used at a roof edge without a gutter. The base panel also includes means for supporting a heat cable within it. Electrical energization of the heat cable results in the conduction of heat through the base panel and through the cover panel, the cover panel including means of overlapping and engaging the base panel. A second heat cable is disposed in the floor of the rain gutter. In an alternative embodiment, the structure for supporting the heat cable within the base panel is configured differently from the first embodiment. In yet another alternative embodiment, a front panel is provided to allow the front lip of the rain gutter to be heated atop a metal gutter screen.

In all of the embodiments, it is desirable that the system and assembly be energized with electrical energy using one or more self-regulating heated cables.

The foregoing and other features of the present invention will be apparent from the detailed description that follows.

DETAILED DESCRIPTION

Figure 1:
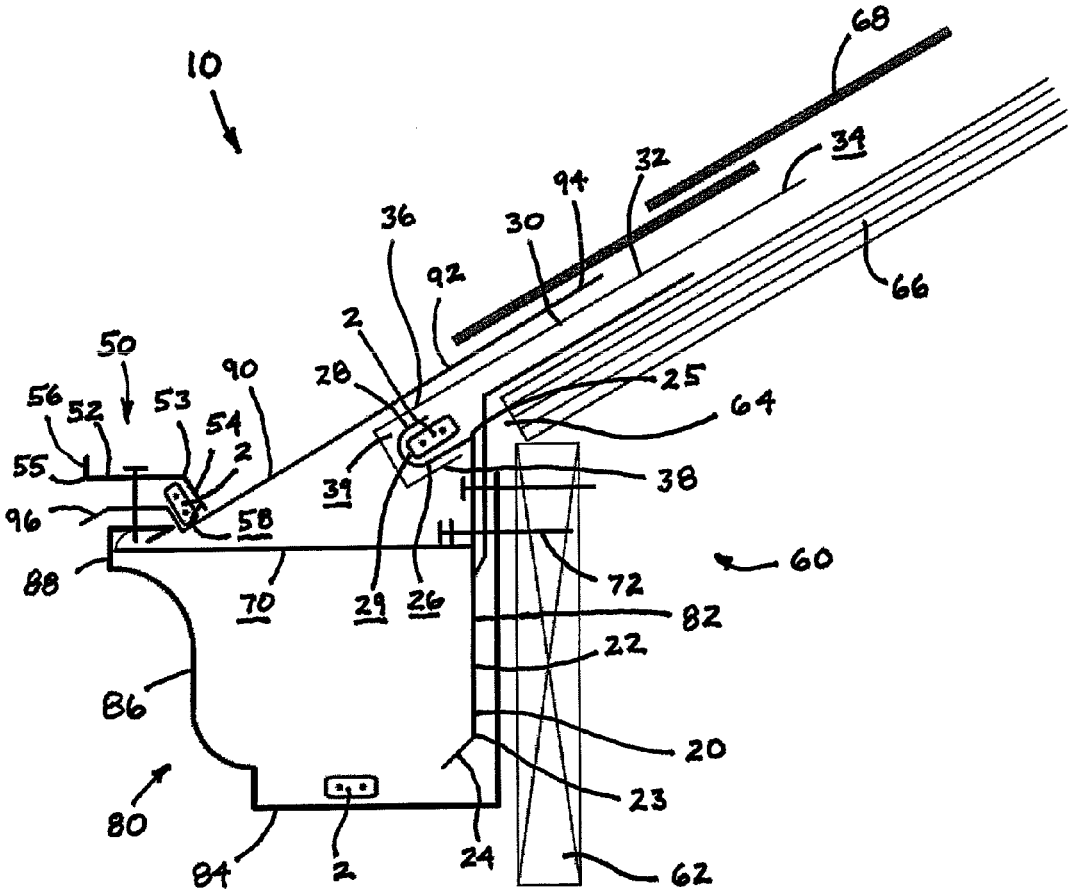
FIG. 1 is a side elevational and cross-sectioned view of a first preferred embodiment of the roof and rain gutter ice melt system and assembly that is constructed in accordance with the present invention, and showing the components as they would be used within a rain gutter of conventional manufacture that is mounted at the roof edge of a building.

Referring now to the drawings in detail wherein like numbers represent like elements throughout, FIG. 1 illustrates a first preferred embodiment of a system and assembly as they would be constructed in accordance with the present invention. Although each component is shown in a cross-sectioned format, it is to be understood that each component comprises a longitudinally-extending and substantially sheet-like structure, or panel, a portion of which is configured to have a self-regulating heat cable supported by it or within it. In the first preferred embodiment, each panel is further designed to be a unitary structure that is fabricated of a metal material such that the heat-transferring capability of the panel is maximized.

FIG. 1 illustrates a number of discrete elements or components of the system and assembly, generally identified 10, as used together in the first preferred embodiment of the present invention. It is to be understood that the numeral 10 references both the system and the assembly, but that the word "assembly" will be used for the balance of this detailed description to describe both the system and the assembly of the present invention.

The first discrete element is an integrally-formed and longitudinally-extending base panel, generally identified 20. As formed, the base panel 20 can be a metal extrusion or other sheet metal structure having a back portion 22, a downwardly and forwardly extending bottom lip portion 24 and a downwardly and forwardly extending top lip portion 26. The bottom lip portion 24 is created by a bend 23 that is formed in the back portion 22. The top lip portion 26 is created by a bend 25 that is formed in the back portion 22 and by a portion 28 that is bent upwardly and rearwardly in a curved configuration to overlay the top lip portion 26. The bend 25 can be made in the shop, during fabrication, or in the field, during installation, to match the pitch of the roof that the assembly 10 will be used with, which will be apparent later in this detailed description. A cavity 29 is formed within the curved portion 28 of the top lip portion 26. In the preferred embodiment, this cavity 29 is used to retain and to run a self-regulating heat cable 2 along the length of the base panel 20. The cavity 29 further serves to protect the heat cable 2 from exposure and potential damage.

Another element of the assembly 10 is an integrally-formed and longitudinally-extending cover panel, generally identified 30, which is also illustrated in FIG. 1. The cover panel 30 can be a metal extrusion or may be fabricated of formed sheet metal material. The cover panel 30 comprises a substantially flat central portion 32 having an upper edge portion 34 and a lower edge portion 36. The lower edge 36 further comprises a rearwardly bent portion 38, the bent portion 38 being bent in a downwardly and rearwardly curved configuration to underlay the lower edge portion 36 of the cover panel 30 to form a cavity 39 within it. The bent portion 38 of the lower edge portion 36 is intended, in the first preferred embodiment, to overlay the bent portion 28 of the top lip portion 26 of the base panel 20, the back panel cavity 29 supporting the cable 2.

FIG. 1 further illustrates another element of the assembly 10 which is an integrally-formed and also longitudinally-extending front panel, generally identified 50. The front panel 50 is functionally adapted to be attached to the forward lip of a rain gutter. The front panel 50 can similarly be a metal extrusion or formed sheet metal part of the assembly 10. The front panel 50 comprises a flat central portion 52, a downwardly and forwardly extending bottom lip portion 54 and an upwardly extending top lip portion 56. The bottom lip portion 54 is formed by a bend 53 that is formed in the central portion 52 and the top lip portion 56 is formed by another bend 55 that is formed in the central portion 52. The bottom lip portion 54 comprises an underside 58 and a self-regulating heat cable 2 that is secured to the underside 58, which cable 2 runs along the length of the front panel 50. The bottom lip portion 54 serves to protect the heat cable 2.

In application, the assembly 10 of the first preferred embodiment of the present invention comprises the previously-discussed elements of the base panel 20 and the cover panel 30. Although the front panel 50 element is illustrated in FIG. 1, it is to be understood that its inclusion comprises an alternative embodiment of the first preferred embodiment of the assembly 10 of the present invention. As shown, the assembly 10 is attachable to a rain gutter 80 of conventional manufacture, the rain gutter 80 typically being a longitudinally-extending structure that is attachable to the roof edge 64 of a building 60. It should be mentioned here, however, that the assembly 10 of the present invention could also be used at a roof edge 64 that does not have a rain gutter 80 attached to it.

In the embodiment shown in FIG. 1, the building 60 comprises a vertical building element 62, the roof edge 64 which presents at an angle relative to the horizontal, a roof deck 66 and shingles 68. The rain gutter 80 is of conventional manufacture and comprises a back wall 82, a floor 84 and a front wall 86, the front wall terminating at a lip 88. The rain gutter 80 is further supported by a hanger 70 and a fastener 72, also of conventional manufacture.

With the rain gutter 80 secured to the vertical building element 62 by means of the hanger 70 and fastener 72, the base panel 20 of the assembly 10 is concomitantly secured by its back portion 22 to the back wall 82 of the rain gutter and, in turn, to the vertical building element 62. The bottom lip portion 24 of the base panel 20 extends down into the rain gutter 80 and the top lip portion 26 extends above it. The cover panel 30 is then secured to the roof deck 66, beneath the shingles 68, such that the cavity 39 of the lower edge portion 36 of the cover panel 30 effectively captures the top lip portion 26 and the curved portion 28 of the base panel 20. In this configuration, and with the heat cable 2 being actuated, ice buildup is prevented along the roof edge 64. With a heat cable 2 secured to the floor 84 of the rain gutter 80, water is also not allowed to re-freeze within the rain gutter 80.

In an alternative embodiment, the assembly 10 is provided with a gutter screen 90, which is also a longitudinally-extending structure that runs along the roof edge 64 atop the rain gutter 80. The gutter screen 90 has a flat central portion 92, an upwardly extending roof edge portion 94 and a downwardly extending gutter edge portion 96. As shown in FIG. 1, the gutter edge portion 96 can be secured to the lip 88 of the gutter 80 with the front panel 50 disposed on top of it. This configuration effectively captures the heat cable 2 between those structures, thereby protecting the cable 2 and preventing ice buildup along the gutter screen 90 at the outer gutter lip 88.

It is to be understood that the self-regulating heat cable 2 that is used in the present invention is not, by itself, novel. Indeed, such cable 2 is well known in the art. When combined with or used in the assembly 10 of the present invention, however, such cable 2 comprises means for regulating the temperature of the cable 2 as needed via a control component which may be pre-programmable. This maximizes performance of the assembly 10 and conserves the use of electrical energy by it.

Figure 2:
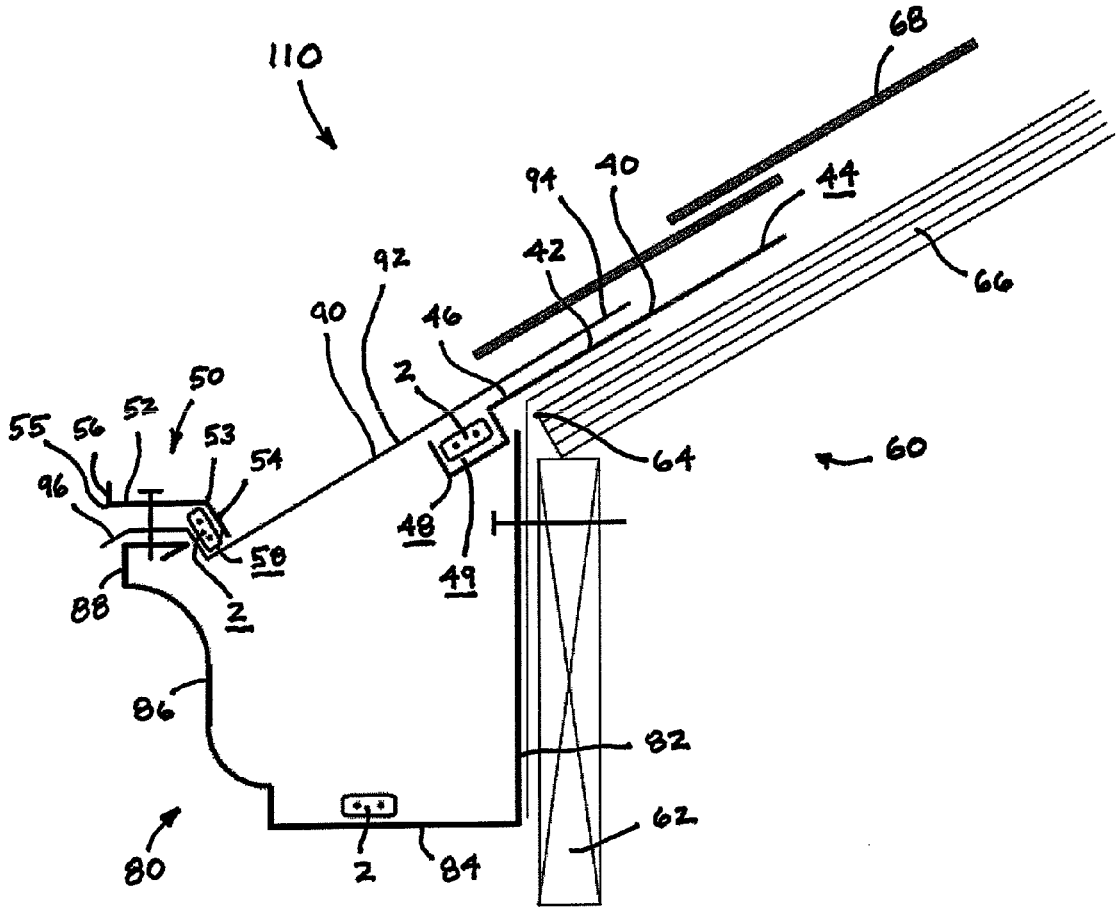
FIG. 2 is a side elevational and cross-sectioned view of a second preferred embodiment of the roof and rain gutter ice melt system and assembly that is constructed in accordance with the present invention, also showing the components as they would be used within a rain gutter of conventional manufacture that is mounted at the roof edge of a building.

Referring now to FIG. 2, it illustrates a second preferred embodiment of the assembly 110 of the present invention. The assembly 110 notably does not comprise the previously-discussed elements of the base panel 20 and the cover panel 30. Instead, the assembly 110 comprises a roof edge panel 40. As shown, the assembly 110 is similarly attached to a rain gutter 80, the rain gutter 80 being a longitudinally-extending structure that is attached to the roof edge 64 of a building 60. Again, the assembly 110 of the present invention could, however, be used at a roof edge 64 that does not have a rain gutter 80 attached to it.

In the embodiment shown in FIG. 2, the building 60 comprises the vertical building element 62, the roof edge 64 which presents at an angle relative to the horizontal, the roof deck 66 and the shingles 68. The rain gutter 80 comprises a back wall 82, a floor 84 and a front wall 86, the front wall terminating at a lip 88. The rain gutter 80 is further supported by a hanger (not shown) and a fastener (also not shown) of conventional manufacture.

As with the first preferred embodiment, it should be noted that the inclusion of the front panel 50 element as illustrated in FIG. 2 comprises an alternative embodiment of the second preferred embodiment of the assembly 110.

Referring again to the integrally-formed roof edge panel 40, FIG. 2 shows that the roof edge panel 40 comprises a substantially flat central portion 42 having an upper edge portion 44 and a lower edge portion 46. The lower edge 46 further comprises a bent portion 48, the bent portion 48 being bent in a downwardly and then upwardly bent configuration to form a cavity 49 within it. A self-regulating heat cable 2 as previously described is contained within this cavity 49. With the rain gutter 80 secured to the vertical building element 62, the roof edge panel 40 of the assembly 110 is secured to the roof deck 66, beneath the shingles 68, such that the cavity 49 of the lower edge portion 46 of the roof edge panel 40 extends away from the roof deck 66. In this configuration, and with the heat cable 2 being actuated, ice buildup is prevented along the roof edge 64. With a heat cable 2 secured to the floor 84 of the rain gutter 80, water is also not allowed to re-freeze within the rain gutter 80.

In an alternative embodiment of the assembly 110 that is shown, the assembly 110 is provided with a gutter screen 90, which is also a longitudinally-extending structure that runs along the roof edge 64 atop the rain gutter 80. The gutter screen 90 has a flat central portion 92, an upwardly extending roof edge portion 94 and a downwardly extending gutter edge portion 96. As shown in FIG. 2, the gutter edge portion 96 can be secured to the lip 88 of the gutter 80 with the front panel 50 disposed on top of it. This configuration effectively captures the heat cable 2 between those structures, thereby protecting the cable 2 and preventing ice buildup along the gutter screen 90 at the outer gutter lip 88.

In view of the foregoing, it will be apparent that there has been provided a new, useful and non-obvious system and assembly that provides the functionality of eliminating or preventing ice dams at a roof edge and that is also relatively simple in its construction and installation.

The details of the invention having been disclosed in accordance with the foregoing, I claim:

1. An ice melt assembly for use with a roof edge of a building and a rain gutter that is attached to the roof edge, a roof deck presenting at an angle relative to the horizontal, shingles disposed atop the roof deck, a vertical building element, and the rain gutter comprising a longitudinally-extending structure and further comprising a back wall adjacent the vertical building element, a floor and a front wall, the front wall of the rain gutter terminating at a lip, the ice melt assembly comprising:

a continuous and extended roof edge back panel, the roof edge back panel comprising a unitary structure consisting of a continuous and extended sheet of heat-conductive metal material having an upwardly-extending back portion that is interposed between the roof deck and the shingles of the building, the back portion presented at the same angle relative to the horizontal as that of the roof deck and the back portion being secured to the roof deck; a downwardly and forwardly extending bottom portion forming a continuous and extended cavity, the cavity being disposed at the back wall of the rain gutter at the roof edge and extending forwardly of the back wall of the rain gutter at the roof edge and forwardly of the roof edge such that the cavity is not covered by the roof shingles and is disposed below the upwardly-extending back portion of the roof edge panel;

a continuous and extended self-regulating first heat cable, the first heat cable being retained within the continuous and extended roof edge panel cavity that is disposed at the roof edge;

a continuous and extended front panel, the continuous and extended front panel being a structure that is separate from the continuous and extended roof edge back panel, the continuous and extended front panel further being disposed at and secured to the lip of the rain gutter, the continuous and extended front panel comprising a continuous and extended flat central portion, a continuous and extended bend, and a continuous and extended bottom lip portion, the bottom lip portion comprising a continuous and extended underside;

a continuous and extended self-regulating second heat cable, the second heat cable being secured to the underside of the continuous and extended bottom lip portion of the front panel; and a continuous and extended gutter screen having a continuous and extended rear edge that is secured between the roof shingles and the roof edge back panel and further having a continuous and extended front edge that is secured between the front panel, the second heat cable and the lip of the rain gutter;

wherein the gutter screen allows the cavity of the roof edge back panel and the first heat cable retained within the cavity to be visualized to prevent a user from securing a fastener to the cavity or the first heat cable; and wherein the gutter screen further allows the second heat cable secured to the underside of the continuous and extended bottom lip portion of the front panel to be visualized to prevent a user from securing a fastener to the cavity or the second heat cable.

2. The ice melt assembly of claim 1 further comprising a third heat cable that is secured to the floor of the rain gutter.

3. An ice melt assembly for use with a roof edge of a building and a rain gutter that is attached to the roof edge, the rain gutter comprising a back wall, a floor and a front wall, the front wall of the rain gutter terminating at a lip, the ice melt assembly comprising:

a continuous and extended roof edge back panel, the roof edge back panel comprising a unitary structure consisting of a continuous and extended sheet of heat-conductive metal material having an upwardly-extending back portion and a downwardly and forwardly extending bottom portion, the bottom portion forming a continuous and extended cavity, the cavity being disposed at the back wall of the rain gutter at the roof edge and extending forwardly of the back wall of the rain gutter at the roof edge and forwardly of the roof edge such that the cavity is disposed below the upwardly-extending back portion of the roof edge panel;

a continuous and extended self-regulating first heat cable, the first heat cable being retained within the continuous and extended roof edge panel cavity that is disposed at the roof edge;

a continuous and extended front panel, the continuous and extended front panel being a structure that is separate from the continuous and extended roof edge back panel, the continuous and extended front panel further being disposed at and secured to the lip of the rain gutter, the continuous and extended front panel comprising a continuous and extended flat central portion, a continuous and extended bend, and a continuous and extended bottom lip portion, the bottom lip portion comprising a continuous and extended underside;

a continuous and extended self-regulating second heat cable, the second heat cable being secured to the underside of the continuous and extended bottom lip portion of the front panel; and a continuous and extended gutter screen having a continuous and extended rear edge that is secured between the roof edge back panel and the front panel, the second heat cable and the lip of the rain gutter;

wherein the gutter screen allows the cavity of the roof edge back panel and the first heat cable retained within the cavity to be visualized to prevent a user from securing a fastener to the cavity or the first heat cable; and wherein the gutter screen further allows the second heat cable secured to the underside of the continuous and extended bottom lip portion of the front panel to be visualized to prevent a user from securing a fastener to the cavity or the second heat cable.

4. The ice melt assembly of claim 3 further comprising a third heat cable that is secured to the floor of the rain gutter.

5. An ice melt assembly for use with a roof edge of a building and a rain gutter that is attached to the roof edge, a roof deck presenting at an angle relative to the horizontal, shingles disposed atop the roof deck, a vertical building element, and the rain gutter comprising a longitudinally-extending structure and further comprising a back wall adjacent the vertical building element, a floor and a front wall, the front wall of the rain gutter terminating at a lip, the ice melt assembly consisting of:

a continuous and extended roof edge back panel, the roof edge back panel consisting of a unitary structure that is a continuous and extended sheet of heat-conductive metal material having an upwardly-extending back portion that is interposed between the roof deck and the shingles of the building, the back portion presented at the same angle relative to the horizontal as that of the roof deck and the back portion being secured to the roof deck; a downwardly and forwardly extending bottom portion forming a continuous and extended cavity, the cavity being disposed at the back wall of the rain gutter at the roof edge and extending forwardly of the back wall of the rain gutter at the roof edge and forwardly of the roof edge such that the cavity is not covered by the roof shingles and is disposed below the upwardly-extending back portion of the roof edge panel;

a continuous and extended self-regulating first heat cable, the first heat cable being retained within the continuous and extended roof edge panel cavity that is disposed at the roof edge;

a continuous and extended front panel, the continuous and extended front panel being a structure that is separate from the continuous and extended roof edge back panel, the continuous and extended front panel further being disposed at and secured to the lip of the rain gutter, the continuous and extended front panel comprising a continuous and extended flat central portion, a continuous and extended bend, and a continuous and extended bottom lip portion, the bottom lip portion consisting of a continuous and extended underside;

a continuous and extended self-regulating second heat cable, the second heat cable being secured to the underside of the continuous and extended bottom lip portion of the front panel; and a continuous and extended gutter screen having a continuous and extended rear edge that is secured between the roof shingles and the roof edge back panel and further having a continuous and extended front edge that is secured between the front panel, the second heat cable and the lip of the rain gutter;

wherein the gutter screen allows the cavity of the roof edge back panel and the first heat cable retained within the cavity to be visualized to prevent a user from securing a fastener to the cavity or the first heat cable; and wherein the gutter screen further allows the second heat cable secured to the underside of the continuous and extended bottom lip portion of the front panel to be visualized to prevent a user from securing a fastener to the cavity or the second heat cable.

6. The ice melt assembly of claim 5 further consisting of a third heat cable that is secured to the floor of the rain gutter.

7. An ice melt assembly for use with a roof edge of a building and a rain gutter that is attached to the roof edge, the rain gutter comprising a back wall, a floor and a front wall, the front wall of the rain gutter terminating at a lip, the ice melt assembly consisting of:

a continuous and extended roof edge back panel, the roof edge back panel consisting of a unitary structure that is a continuous and extended sheet of heat-conductive metal material having an upwardly-extending back portion and a downwardly and forwardly extending bottom portion, the bottom portion forming a continuous and extended cavity, the cavity being disposed at the back wall of the rain gutter at the roof edge and extending forwardly of the back wall of the rain gutter at the roof edge and forwardly of the roof edge such that the cavity is disposed below the upwardly-extending back portion of the roof edge panel;

a continuous and extended self-regulating first heat cable, the first heat cable being retained within the continuous and extended roof edge panel cavity that is disposed at the roof edge;

a continuous and extended front panel, the continuous and extended front panel being a structure that is separate from the continuous and extended roof edge back panel, the continuous and extended front panel further being disposed at and secured to the lip of the rain gutter, the continuous and extended front panel comprising a continuous and extended flat central portion, a continuous and extended bend, and a continuous and extended bottom lip portion, the bottom lip portion comprising a continuous and extended underside;

a continuous and extended self-regulating second heat cable, the second heat cable being secured to the underside of the continuous and extended bottom lip portion of the front panel; and a continuous and extended gutter screen having a continuous and extended rear edge that is secured between the roof edge back panel and the front panel, the second heat cable and the lip of the rain gutter;

wherein the gutter screen allows the cavity of the roof edge back panel and the first heat cable retained within the cavity to be visualized to prevent a user from securing a fastener to the cavity or the first heat cable; and wherein the gutter screen further allows the second heat cable secured to the underside of the continuous and extended bottom lip portion of the front panel to be visualized to prevent a user from securing a fastener to the cavity or the second heat cable.

8. The ice melt assembly of claim 7 further consisting of a third heat cable that is secured to the floor of the rain gutter.

* * * * *